US006627002B1

(12) United States Patent
Millonzi et al.

(10) Patent No.: US 6,627,002 B1
(45) Date of Patent: Sep. 30, 2003

(54) HOLLOW CYLINDRICAL IMAGING MEMBER TREATMENT PROCESS WITH SOLID CARBON DIOXIDE PELLETS

(75) Inventors: Richard P. Millonzi, Webster, NY (US); Robert S. Foltz, Rochester, NY (US); Richard C. Petralia, Rochester, NY (US); Leslie W. Caccamise, Leroy, NY (US); Harold F. Hammond, Webster, NY (US); David P. Crump, Rochester, NY (US); Robert E. McCumiskey, Rochester, NY (US); Edward C. Williams, Palmyra, NY (US)

(73) Assignee: Xerox Corporation, Stamford, CT (US)

( * ) Notice: Subject to any disclaimer, the term of this patent is extended or adjusted under 35 U.S.C. 154(b) by 246 days.

(21) Appl. No.: 09/628,865

(22) Filed: Jul. 28, 2000

(51) Int. Cl.[7] ..... B08B 7/00; B08B 9/027

(52) U.S. Cl. ..... 134/7; 134/8; 134/34; 451/40; 451/53

(58) Field of Search ..... 134/7, 8, 34; 15/3.5, 15/304, 320; 451/40, 53

(56) References Cited

U.S. PATENT DOCUMENTS

| | | | | |
|---|---|---|---|---|
| 4,191,201 A | | 3/1980 | Barnsbee | 134/104 |
| 4,426,311 A | | 1/1984 | Vander Mey | 252/143 |
| 5,062,898 A | | 11/1991 | McDermott et al. | 134/7 |
| 5,108,512 A | | 4/1992 | Goffnett et al. | 134/7 |
| 5,209,028 A | | 5/1993 | McDermitt et al. | 51/426 |
| 5,294,261 A | | 3/1994 | McDermott et al. | 134/7 |
| 5,372,652 A | | 12/1994 | Srikrishnan et al. | 134/7 |
| 5,390,450 A | | 2/1995 | Goenka | 451/75 |
| 5,431,740 A | | 7/1995 | Swain | 134/7 |
| 5,445,553 A | * | 8/1995 | Cryer et al. | 451/39 |
| 5,514,024 A | | 5/1996 | Goenka | 451/39 |
| 5,576,803 A | * | 11/1996 | Williams et al. | 399/116 |
| 5,616,067 A | | 4/1997 | Goenka | 451/39 |
| 5,630,196 A | | 5/1997 | Swain | 399/117 |
| 5,679,062 A | | 10/1997 | Goenka | 451/75 |
| 5,766,368 A | | 6/1998 | Bowers | 134/6 |
| 5,782,263 A | | 7/1998 | Isaacson, Jr. et al. | 137/487.5 |
| 5,836,809 A | | 11/1998 | Kosic | 451/89 |
| 5,853,128 A | | 12/1998 | Bowen et al. | 239/329 |
| 5,976,264 A | | 11/1999 | McCullough et al. | 134/2 |

* cited by examiner

*Primary Examiner*—Randy Gulakowski
*Assistant Examiner*—Joseph Perrin
(74) *Attorney, Agent, or Firm*—Robert T Thompson; E. O. Palazzo

(57) ABSTRACT

A process for treating an electrostatographic imaging member including providing a hollow cylindrical electrostatographic imaging member having an interior surface, a coated outer surface, a first end and a second end, the interior surface at at least the first end having a coating of adhesive material securing a first end flange to the first end, and propelling solid carbon dioxide pellets against the first end flange and coating of adhesive material with sufficient force to remove the first end flange and coating of adhesive material from the interior surface at at least the first end of the hollow cylindrical electrostatographic imaging member.

20 Claims, 2 Drawing Sheets

HOLLOW CYLINDRICAL IMAGING MEMBER TREATMENT PROCESS WITH SOLID CARBON DIOXIDE PELLETS

BACKGROUND OF THE INVENTION

This invention relates in general to a process for treating electrostatographic imaging members and, more specifically, to a process for removing adhesives from the interior of hollow cylindrical electrostatographic imaging members Electrostatographic imaging members, such as photoreceptors, are conventionally utilized for copiers and printers and comprise a hollow electrically conductive drum substrate, which has been dip coated with various coatings, including at least one photoconductive coating comprising pigment particles dispersed in a film-forming binder. These drum type photoreceptors are usually supported on an electrically conductive shaft by drum supporting hubs or end flanges. The hubs are usually constructed of plastic material and have a hole through their center into which a supporting axle shaft is inserted. Since hubs are usually constructed of electrically insulating plastic material, any suitable electrical grounding means such as a flexible spring steel metal strip is secured to the hub and positioned to contact both the electrically conductive axle shaft and the electrically conductive metal substrate of the photoreceptor drum. One type of grounding means is illustrated In U.S. Pat. No. 4,561,763.

Often the hub or end flange is secured to the end of the drum by a resin adhesive. The use of an adhesive increases the number of steps and complexity of equipment required to disassemble a hub and cylindrical member assembly. Recycling of used drums having glued hubs is difficult, if not impossible, because of damage to the hub, or to the drum or to both during removal of the hub from the drum by common techniques such as by hammering. Such removal techniques damage or destroy both the drum and the hub. Further, where disassembly is accomplished without damage, cleaning of both the hub and the cylindrical substrate is required to remove adhering adhesive. Such removal is particularly difficult when the adhesive is a thermosetting adhesive. Although solvents may be employed to remove thermoplastic adhesives, such solvents can damage drum coatings of new drums. Moreover, solvent handling requires complex equipment such as special solvent recovery units and is time intensive. Alternate methods such as mechanical abrasion or immersion in liquid nitrogen render the photoreceptor unusable due to distortion and mechanical abrasion.

Thus, there is a continuing need for improved photoreceptors that are more reliable and facilitate recycling.

INFORMATION DISCLOSURE STATEMENT

U.S. Pat. No. 5,853,128 issued to Bowen et al. on Dec. 29, 1998—Method and apparatus are disclosed for controlling the exit velocity of solid/gas carbon dioxide spray cleaning systems. By increasing the pressure of liquid carbon dioxide in the supply line, typically In the range of 800–875 psi, to greater than 875 psi, preferably 2,000–5,000 psi and above, the velocity of the spray stream exiting the nozzle is increased enabling removal of contamination (oils, fingerprints, particles, graffiti, etc.) not removable with a spray stream using conventional carbon dioxide pressures. The apparatus includes the incorporation of a high-pressure pump in the liquid carbon dioxide supply line in combination with a nozzle having a first or inlet orifice smaller in diameter than the supply line and a second or exit orifice larger in diameter than the inlet orifice.

U.S. Pat. No. 5,782,263 issued to Isaacson, Jr. et al. on Jul. 21, 1998—A flood control device 200 is disclosed which measures the volume of fluid delivered in a continuous steady flow to a house or building and which shuts off the fluid flow if a preset maximum limit is reached, indicating overly high consumption due to a leak, break or open faucet in the plumbing of the house or building.

U.S. Pat. No. 5,766,368 issued to Bowers on Jun. 16, 1998—A method is disclosed of cleaning an integrated circuit chip module prior to attaching wire bonds thereto. The method involves disposing a module containing an integrated circuit chip and IC bond pads without wire bonds in an environmental process enclosure. A carbon dioxide jet spray cleaning system having a spray nozzle and orifice assembly is disposed the environmental process enclosure. A jet spray of carbon dioxide is generated using the jet spray cleaning system. The carbon dioxide jet spray is directed onto the surface of the module such that the spray impacts the IC bond pads and module bond pads to clean unwanted adhesive from the surface of the module and thus clean the IC and module bond pads.

U.S. No. 5,514,024 issued to Goenka on May 7, 1996—$CO_2$ nozzle is disclosed which expels liquid $CO_2$ under pressure through an orifice therein for converting the liquid into $CO_2$ snow. The $CO_2$ nozzle is contained within an elongated mixing cavity within a body which is coupled to an exhaust nozzle for directing the $CO_2$ snow toward the workpiece. The $CO_2$ nozzle includes several wings for creating aerodynamic turbulence within the elongated mixing cavity for enhancing the coagulation of the $CO_2$ snow into larger $CO_2$ snow particles or $CO_2$ snowflakes.

U.S. Pat. No. 5,431,740 issued to Swain on Jul. 11, 1995—An apparatus is disclosed for cleaning cylindrical surfaces includes a plurality of cleaning stations. Each cleaning station is designed to receive a substrate and includes a plurality of nozzles. The inlet end of each nozzle is connected to a source of liquid Carbon Dioxide, and the outlet end of each nozzle is connected to one end of a respective Carbon Dioxide expansion chamber. Liquid Carbon dioxide leaving each nozzle is converted to solid Carbon Dioxide in the corresponding expansion chamber. The other end of each Carbon Dioxide expansion chamber is coupled to a respective funnel which is, in turn, connected to a dispersing saddle. The dispersing saddles disperse the stream of solid Carbon Dioxide particles leaving each funnel and direct these particles to the substrate surface. The dispersing saddles are placed such that the entire circumference of the substrate surface is enveloped within the various streams of solid Carbon Dioxide particles. In addition, the apparatus may include a source of a dry nonreactive gas which is introduced into each stream of solid Carbon Dioxide particles in order to reduce condensation on the surface from the surface of the substrate and to further direct each stream of solid Carbon Dioxide particles to the substrate surface.

U.S. Pat No. 5,372,652 issued to Srikrishnan et al. on Dec. 13, 1994—An aerosol cleaning apparatus is disclosed for cleaning a substrate includes an aerosol producing means having a nozzle head. The nozzle head is positioned at a selected proximity and orientation to the substrate which is held by a rotatable holder. The aerosol spray dislodges particles from the substrate and the rotation of the substrate further assists in the removal of the loosened particles. A method of aerosol cleaning includes rotating a substrate at a preselected speed and spraying an aerosol jet in conjunction with the rotation to help in the removal of particles from the substrate.

U.S. Pat. No. 5,294,261 issued to McDermott et al. on Mar. 15, 1994—A method is disclosed for cleaning microelectronic surfaces using an aerosol of at least substantially solid argon or nitrogen particles which impinge upon the surface to be cleaned and then evaporate and the resulting gas is removed by venting along with the contaminants dislodged by the cleaning method.

U.S. Pat. No. 5,209,028 to McDermott et al, issued May 11, 1993—An apparatus is disclosed for cleaning semiconductor solid surfaces using a spray of frozen cryogen, such as argon, to impinge on the solid surface to remove contaminant particles. The apparatus includes an appropriate nozzle positioned in a housing designed for ultra clean conditions including sweep gas supply and evacuation conduits and a support table movably positioned within the housing to controllably convey the semi-conductor solid surface on a track under the spray of frozen cryogen emanating from the nozzle.

U.S. Pat. No. 5,062,898 issued to McDermott et al. on Nov. 5, 1991—A method is disclosed for cleaning microelectronics surfaces using an aerosol of at least substantially solid argon particles which impinge upon the surface to be cleaned and then evaporate and the resulting gas is removed by venting along with the contaminants dislodged by the cleaning method.

U.S. Pat. No. 4,426,311 issued to Vander Mey on Jan. 17, 1984—Methylene chloridemethane sulfonic acid compositions used in removing polymeric organic substances from inorganic substrates, such as polymeric adhesives from metal and lense glass parts and positive and negative photoresists from metallized silicon/silicon dioxide wafers, which comprise an effective amount, usually about 1 to 40 percent by weight methane sulfonic acid and the balance methylene chloride are described. Methods for using the above composition at ambient temperatures to remove the polymeric organic substances from the metal and nonmetallic inorganic substrates are also described.

U.S. Pat. No. 4,191,201 issued to Barnsbee on Mar. 4, 1980—Plastic film cartridges generally comprise a variety of component parts plus a label affixed by adhesive to the cartridge housing. The cartridge housing (a plastic) is recyclable when the label and adhesive are removed and the housing is separated from the other non-compatible plastic and non-plastic cartridge components. In accordance with the invention, multi-stage reclaiming apparatus is disclosed wherein film cartridges are first rough chopped to provide physical separation of the cartridge components. The cartridge housing pieces are separated from other cartridge components on the basis of differences in specific gravity in a series of specific gravity separation tanks. To remove the labels and adhesive from the housing pieces, a separation tank contains a detergent solution capable of assisting in dissolving the adhesive. The tank is provided with a group of heating elements to cause the detergent solution to boil in the immediate vicinity thereof. As housing pieces travel past the heating elements they are rolled around, swirled and submerged and each housing piece with a label portion adhered thereto is exposed to the boiling detergent solution. The adhesive is thus dissolved and the label portions are driven off the housing pieces.

U.S. Pat. No. 5,616,067 to Goenka, issued Apr. 1, 1997—In an apparatus for cleaning a workpiece with abrasive $CO_2$ particles, a $CO_2$ nozzle receives and expels liquid $CO_2$ through at least one orifice sized for at least partially converting the liquid into $CO_2$ particles. The $CO_2$ particles are injected into a converging-diverging nozzle at a location adjacent to the throat section thereof. Pressurized air is directed into the converging section of the nozzle upstream from the throat section. The pressurized air accelerates the $CO_2$ particles which are focused by the diverging section of the nozzle for impacting the pressure-sensitive surface of the workpiece to be cleaned.

U.S. Pat. No. 5,390,450 to Goenka, issued Feb. 21, 1995—A $CO_2$ nozzle receives and expels liquid $CO_2$ through orifices sized for converting the $CO_2$ liquid into $CO_2$ snow. A body, defining an elongated cavity therein, is coupled to the $CO_2$ nozzle such that the $CO_2$ snow is ejected into the cavity. An exhaust nozzle is coupled to the body and the cavity therein for directing the pressurized $CO_2$ snow toward the workpiece. The exhaust nozzle is operated in an overexpanded mode for containing the shockwave within the nozzle for reducing the shear noise therefrom. Pressurized air is injected into the elongated cavity for exhausting the $CO_2$ snow under pressure.

U.S. Pat. No. 5,679,062 to Goenka, issued Oct. 21, 1997—An apparatus and method for cleaning a workpiece with abrasive $CO_2$ snow operates with a nozzle for creating and expelling the snow. The nozzle includes an upstream section defined by a first contour for receiving $CO_2$ in a gaseous form. The nozzle also includes a downstream section for directing the flow of the $CO_2$ and the snow toward the workpiece, with the downstream section having a second contour optimized for supersonic flow of the $CO_2$. The nozzle includes a throat section, interposed between the upstream and downstream sections, for changing the $CO_2$ from gaseous phase to an intermediate mixture of $CO_2$ gas, liquid and snow within the downstream section at a speed of at least Mach 1.1. A turbulence cavity section is interposed between the throat section and the downstream section for inducing both turbulence within the $CO_2$ gas flowing therethrough, thereby increasing the nucleation and agglomeration of the $CO_2$ within a snow zone defined within the downstream section. The throat, upstream, turbulence cavity and downstream sections of the nozzle may be manufactured from silicon micromachined surfaces.

U.S. Pat. No. 5,976,264 to McCullough et al, issued Nov. 2, 1999—A method for the removal of fluorine or chlorine residue from an etched precision surface such as a semiconductor sample is provided which comprises exposing said precision surface to liquid $CO_2$ under appropriate conditions that are sufficient to remove the residue from the precision surface. Cryogenic aerosol may be used in conjunction with liquid $CO_2$.

U.S. Pat No. 5,836,809 to Kosic, issued Nov. 17, 1998—In accordance with the teachings of the present invention, an apparatus and method for cleaning large glass plates each having first and second major surfaces is provided. The apparatus (10) includes an enclosure (14) which maintains a cleaning environment in which a glass plate (42) is decontaminated. An actuated support member (40) vertically translates the glass plate (42) into the enclosure (14) where it is supported with its first (46) and second (48) major surfaces substantially perpendicular to a ground plane defined by the floor space (12) occupied by the apparatus (10). A pair of opposing arrays of jet spray nozzles (62 and 64) coupled to a pressurized supply of liquid carbon dioxide (94) is provided for simultaneously directing carbon dioxide snow particles (96) in directions of the first and second major surfaces (46 and 48) of the glass plate (42), thereby removing contamination therefrom. The carbon dioxide snow particles (96) sublime within the cleaning environment of the enclosure (14).

U.S. Pat. No. 5,108,512 to Goffnett et al, issued on Apr. 28, 1992—A process is disclosed for the cleaning of the inner surfaces of a chemical vapor deposition reactor used in the production of polycrystalline silicon. The process comprises impacting the surfaces to be cleaned with solid carbon dioxide pellets. The carbon dioxide pellets dislodge silicon deposits from the surface of the reactor without damaging the surface of the reactor and without providing a source for contamination of polycrystalline silicon produced in the cleaned reactor. The present process is particularly useful for the cleaning of the inner surfaces of chemical vapor deposition reactors used in the production of semi-conductor grade silicon.

U.S. Pat. No. 5,630,196 to Swain, issued May 13, 1997—A hollow cylinder supporting end flange is disclosed comprising a disk shaped member having a circular periphery and a coil spring having a major plane substantially parallel to the major plane of the disk shaped member, an exposed arcuate outer periphery having a diameter larger than the inside diameter of the hollow cylinder, an outer exposed end and an inner end, the inner end comprising a section secured to the end flange and the exposed arcuate outer periphery of the coil spring being adjacent the circular periphery of the disk shaped member for engagement with a hollow cylindrical member upon insertion of the coil spring into the hollow cylindrical member. This end flange may be utilized as a component of an assembly comprising a hollow cylindrical electrostatographic imaging member having a circular cross section and an inner surface, and an end flange secured to at least one end of the hollow cylindrical member by means of a partially wound coil spring, the spring having an inner end and an outer end, the inner end being secured to the end flange and the outer end having an exposed arcuate outer surface in frictional contact with the inner surface of the hollow cylindrical member.

CROSS REFERENCE TO COPENDING APPLICATIONS

U.S. patent application Ser. No. 09/210,186, entitled "MOUNTING ELECTROSTATOGRAPHIC END FLANGE" filed on Dec. 11, 1998, in the names of Swain et al—A process is disclosed for fabricating an electrostatographic imaging member assembly including providing a hollow electrostatographic drum having a first end and a second end, the first end having a surface selected from the group consisting of an uncoated surface, a surface coated with only a first component of for a multiple component adhesive, a surface coated with only a second component for the multiple component adhesive, the second component being containing a fluorescent tracer which fluoresces when irradiated with activating radiation, and a surface coated with a mixture of the first component and the second component containing the fluorescent tracer, directing activating radiation at the surface of the first end, detecting the amount of fluorescence emitted from the surface of the first end, and generating a signal which is substantially proportional to the intensity of fluorescence emitted from the surface of the first end, the signal ranging through at least three levels of strength, the first level representing an uncoated surface or a surface coated with only the first component, the second level representing a mixture of the first component and the second component containing the fluorescent tracer, and the third level representing only the second component containing the fluorescent tracer. Apparatus for carrying out this process is also disclosed.

U.S. patent application Ser. No. 09/627,880, entitled "PROCESS FOR ROUGHENING A SURFACE" filed concurrently herewith, in the names of P. Perry et al. A process is disclosed including providing a member having an exposed outer metal surface and propelling irregularly shaped solid carbon dioxide granules against the exposed outer metal surface with sufficient force to alter the texture of the outer metal surface to a predetermined surface roughness.

U.S. patent application Ser. No. 09/628,258, entitled "PROCESS FOR REMOVING COATINGS" filed concurrently herewith, in the names of G. Arserio et al. A process is disclosed including providing a substrate having an outer surface having coatings thereon including an undercoat layer and at least one electrophotoactive layer, and propelling solid carbon dioxide irregular granules against the coating to remove the at least one electrophotoactive layer from the undercoat layer.

BRIEF SUMMARY OF THE INVENTION

It is, therefore, an object of the present invention to provide an improved process for removing glued end flanges from the ends of hollow cylindrical electrostatographic imaging members.

It is another object of the present invention to provide an improved process for removing glued end flanges from the ends of hollow cylindrical electrostatographic imaging members which is environmentally safe.

It is still another object of the present invention to provide an improved process for removing glued end flanges from the ends of hollow cylindrical electrostatographic imaging members which does not damage the interior surface.

It is yet another object of the present invention to provide an improved process for removing glued end flanges from the ends of hollow cylindrical electrostatographic imaging members which does not distort the end flanges and the imaging members.

It is another object of the present invention to provide an improved process for removing glued end flanges from the ends of hollow cylindrical electrostatographic imaging members that does not generate additional hazardous wastes or hydrocarbon emissions into the air.

The foregoing objects and others are accomplished in accordance with this invention by providing a process for treating an electrostatographic imaging member comprising a hollow cylindrical electrostatographic imaging member having an interior surface, a coated outer surface, a first end and a second end, the interior surface at at least the first end having an end flange secured thereto with an adhesive material, and propelling solid carbon dioxide pellets against the end flange and adhesive to thermally shock and remove the end flange and adhesive material from the interior surface at at least the first end of the hollow cylindrical electrostatographic imaging member.

DESCRIPTION OF THE DRAWINGS

A more complete understanding of the present invention can be obtained by reference to the accompanying drawings wherein.

Figure 1:
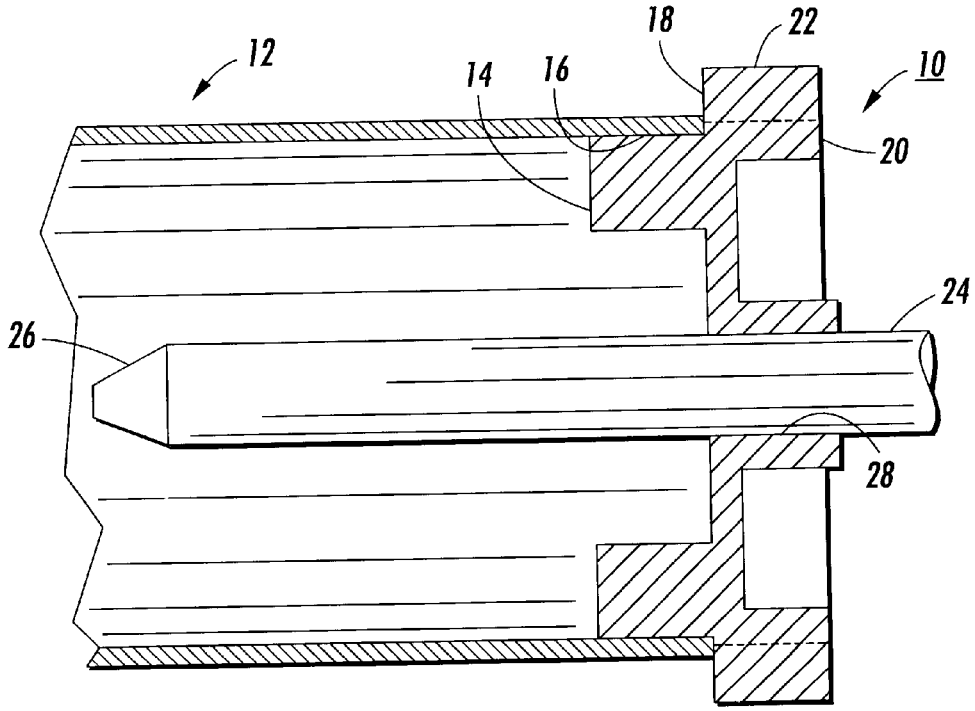
FIG. 1 is a partial schematic cross sectional illustration of a drum supporting end flange mounted in one end of a hollow cylindrical member.

These figures merely schematically illustrate the invention and are not intended to indicate relative size and dimensions of the device or components thereof.

DETAILED DESCRIPTION OF THE DRAWING

FIG. 1 illustrates a detailed side view of a first drum supporting end flange 10 and hollow cylindrical member 12. As seen in this view end flange 10 has a first rim 14 having a circular periphery 16 which assists in centering end flange 10 in the end of hollow cylindrical member 12 so that they are coaxial. A shoulder 18 is provided in hub 20 to maintain the position of flange 10 relative to the end of hollow cylindrical member 12. Hub 20 may optionally comprise molded gear teeth 22 around the outer periphery thereof.

First rim 14 may be molded together with hub 20 and molded gear teeth 22 forming a single unit. If desired, rim 14 and hub 20 may be separately formed (not shown) and thereafter fastened to together by any suitable technique such as by an adhesive, screws, bolts, Interlocking tab and grooves, rivets, and the like (not shown). Rim 14 ensures that end flange 10 Is centered in and coaxial with the end of hollow cylindrical member 12. A slight press or resistance fit of rim 14 of flange 10 into the end of hollow cylindrical member 12 may be desirable to prevent misalignment of end flange 10 after Installation in the end of hollow cylindrical member 12, but prior to hardening of an adhesive by drying or curing. The adhesive is located at the interface between a first end of cylindrical member 12 and circular periphery 16 of rim 14. This ensures that end flange 10 remains coaxial with cylindrical member 12 after installation. If desired, the side of rim 14 facing the interior surface of hollow cylindrical member 12 may be tapered, beveled or otherwise or Inclined toward the drum centerline (not shown) to facilitate insertion of end flange 10 into one end of cylindrical member 12 and to promote a snug fit between end flange 10 and cylindrical member 12. Thus, for example, rim 14 may have a truncated cross section (not shown). However, most of the side of rim 14 facing the Interior surface of hollow cylindrical member 12 for adhesive attachment to the interior surface of cylindrical member 12 is preferably parallel to the interior surface of drum 12. Typical physical widths for rim 14 are, for example, between about 0.5 centimeter and about 2 centimeters for a cylindrical member 12 having an inside diameter between about 2 centimeters and about 10 centimeters. Rim 14 may comprise a continuous rim or a plurality of rim segments (not shown). Alternatively, instead of using rim 14, a conventional circular recess, groove or slot (not shown) may be formed in hub 20 to accept the end of cylindrical member 12. In this alternative embodiment, the surface of the recess contacting the Interior surface of the drum 12 Is equivalent in function and appearance to the circular periphery 16 of rim 14. Any suitable supporting shaft 24 may be utilized to support end flange 10. End flange 10, drum 12 and shaft 24 share a common axis. Support shaft 24 preferably has a pointed end 26 to facilitate Insertion of shaft 24 through hole 28 into the interior of hollow cylindrical member 12. End flange 10 preferably has a circular periphery. Hole 28 is concentric with end flange 10. Instead of pointed end 26, shaft 24 may have ends of any other suitable shape. Typical shapes include, for example, pointed ends, rounded ends, flat ends, and the like. The shaft 24 may comprise any suitable material including, for example, metals such as steel, stainless steel, and the like; polymers such as polyesters, polycarbonates, polyamides, and the like; of reinforced polymers such as glass fiber and graphite fiber reinforced plastics, and the like. End flange 10 may be secured to shaft 24 by any suitable and conventional device (not shown) such as a set screw, key and slot combination, pins, and the like. Alternatively, end flange 10 may be driven directly by hexagonal or square support shafts (not shown) which mate with correspondingly shaped openings (not shown) in end flange 10. The support shaft can be driven directly by an electric motor (not shown) or by any other suitable power source as is well known in the art. Alternatively, end flange 10 may freely rotate on the support shaft 24. Moreover, instead of a support shaft which extends through the entire length of the hollow cylindrical member, the end flange may have a molded support shaft stub (not shown) which extends away from the hollow cylindrical member. This latter embodiment preferably utilizes an electrically conductive end flange. Techniques for adhesively installing an end flange into one end of a hollow cylindrical imaging member are know and described, for example, U.S. Pat. No. 6,157,038, entitled "MOUNTING ELECTROSTATOGRAPHIC END FLANGE" filed on Dec. 11, 1998, the entire disclosure thereof being incorporated herein by reference.

Figure 2:
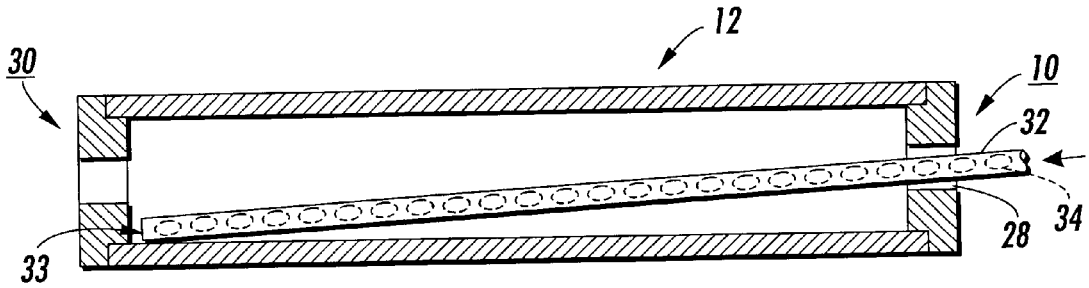
FIG. 2 is a schematic illustration of a partial schematic cross sectional illustration of drum supporting end flanges mounted in the ends of a hollow cylindrical member and a nozzle propelling carbon dioxide pellets against part of one of the flanges and part of the hollow cylindrical member adjacent the flange.

Illustrated in FIG. 2, is a first drum supporting end flange 10 mounted in a first end of a hollow cylindrical member 12 and a second drum supporting end flange 30 mounted in a second end of hollow cylindrical member 12. Unlike, the assembly shown in FIG. 1, the shaft 24 has been withdrawn from hole 28 to allow the insertion of nozzle 32. The open end 34 of nozzle 32 is positioned in such a way as to project carbon dioxide pellets 34 against both the flange 30 and the portion of hollow cylindrical member 12 adjacent to flange 30. Nozzle 32 is supplied with carbon dioxide pellets 34 under pressure from any suitable source (not shown). This embodiment may be used to merely remove the flange or to remove both the flange and all of the adhesive on the drum. Thus, for example, if all of the adhesive is not removed during removal of the flange 30, the arrangement illustrated in FIG. 3 may used to remove all of the remaining adhesive after the flange is removed.

Figure 3:
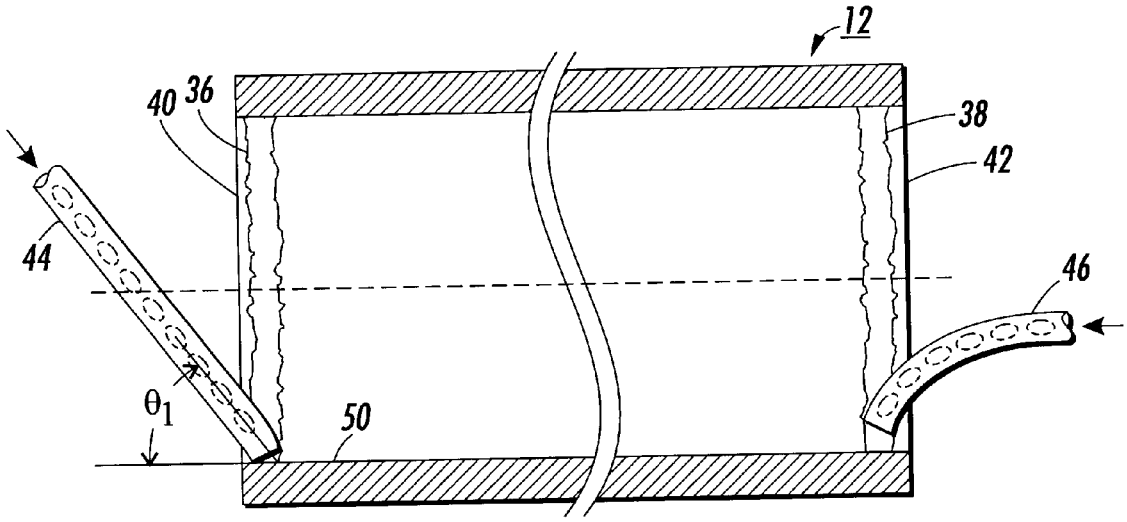
FIG. 3 is a schematic cross sectional side view illustration of various nozzles propelling carbon dioxide pellets against residual adhesive coatings on the interior surfaces at each end of a hollow cylindrical member.

Shown in FIG. 3 is a schematic cross sectional side view of hollow cylindrical member 12 having narrow adhesive material coating strips 36 and 38 at a first end 40 and second end 42, respectively. Strips 36 and 38 are generally adjacent to and parallel to the ends 40 and 42, and extend around most of the inner peripheral surface of hollow cylindrical member 12. Nozzles 44 and 46 propel carbon dioxide pellets at adhesive material coating strips 36 and 38, respectively. Nozzles 44 and 46 may be of any suitable shape. For example, nozzle 44 is straight and nozzle 46 is curved. The curve in nozzle 46 is preferably smooth to avoid jamming and clogging of the flow of pellets in the nozzle. The preferred angle range within which the stream of propelled carbon dioxide pellets strikes the adhesive material coating 36 is represented by $\theta_1$. The angle $\theta_1$ is measured IS from an imaginary line extending away from the interior surface 50 of hollow cylindrical member 12 in a direction parallel to the axis of hollow cylindrical member 12. The apex of angle $\theta_1$ is located in the center of the thickness of the original adhesive layer 36. The angle $\theta_1$ for any given stream is determined by observing a cross sectional side view of the imaging member. Similarly, the mirror image angle (where the nozzle is bent and propelled particles bounce off the adhesive layer 36 and out of the adjacent open first end 40 of the imaging member) may also be employed. The angle $\theta_1$ of the stream of carbon dioxide pellets directed at the adhesive deposit is preferably between about 10° and about 60° relative to an imaginary extension of the inner surface of the photoreceptor drum when the nozzle is located at the end of the drum where the adhesive deposits to be removed are also-located. However, where the supply of carbon dioxide pellets is provided from the end of the drum opposite the end which contains the adhesive deposit (e.g. see FIG. 1), the angle may be less than about 10° relative to the inner surface of the drum. This assumes that the pellets are fed through a straight tube directly to a nozzle having an opening within an axis common to the axis of the feed tube. Moreover, the nozzle or feed tube may be bent (see nozzle 46) to achieve a sharper angle of attack between a stream of carbon dioxide pellets and the adhesive deposits. This localized removal of adhesive material does not affect coatings elsewhere on the drum because of the focused nature of the adhesive removal process.

Figure 4:
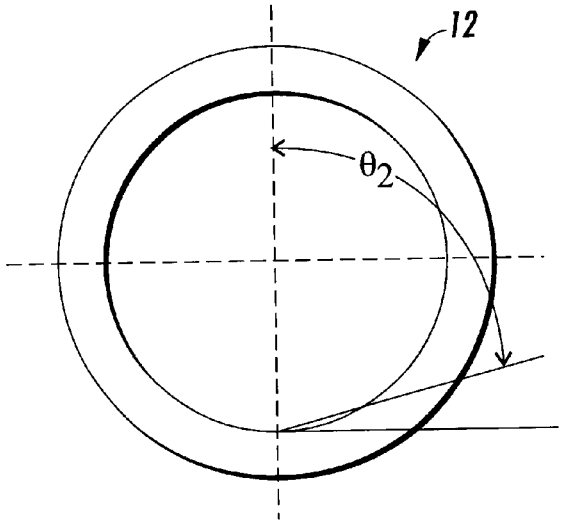
FIG. 4 is a schematic cross sectional end view illustration of angles of attack for propelled carbon dioxide pellets against residual adhesive coatings on the interior surface at one end of a hollow cylindrical member.

Illustrated in FIG. 4 is an a schematic cross sectional end view of hollow cylindrical member 12. The angles of attack $\theta_2$ for a stream of propelled carbon dioxide pellets against an adhesive coating (not shown) on the interior surface at one end of a hollow cylindrical member is shown. The angle $\theta_2$ is measured from an imaginary plane extending through the axis of hollow cylindrical member 12 in a direction parallel to the axis of hollow cylindrical member 12. The apex of angle 62 is located at the inside edge of the adhesive layer 36 (see FIG. 3) in the region being struck by the stream of propelled carbon dioxide pellets. The nozzle opening may be centered over the adhesive layer 36 or may be translated by starting from either the outside and moving into the interior of member 12 or by starting from the inside and moving out of the interior of member 12 to remove the adhesive. The angle 62 for any given stream is determined by observing an end view of the hollow cylindrical member 12. Preferably, angle $\theta_2$ is between about 10 degrees and about 60 degrees. Alternatively, the mirror image angle of angle $\theta_2$ may be employed.

Hollow cylindrical member 12 is preferably an electrostatographic imaging drum. Electrostatographic imaging drums usually comprise a hollow cylindrical electrically conductive substrate and at least one electrostatographic imaging layer. Electrostatographic imaging layers are well known in the art and may comprise a dielectric layer for electrographic imaging or at least one electrophotographic imaging layer for electrophotographic imaging. Preferably, the hollow cylindrical electrically conductive substrate comprises a metal such as aluminum, because it conducts heat energy more rapidly and has a relatively large coefficient of contraction. In view of the large difference in coefficient of contraction between the conventional aluminum substrate and the coefficient of contraction between the conventional plastic end flange, a shearing effect occurs that further facilitates separation of the flange from the substrate.

Any suitable end flange 12 may be utilized for the adhesively secured drum-flange assembly. Flange 12 may comprise any suitable metal, plastic or combination of a metal and a plastic materials. Although more expensive, typical metals include, for example, steel, aluminum, copper, bronze, brass and the like. Typical plastic materials include thermosetting or thermoplastic resins which are dimensionally stable. These plastic members may be filled r unfilled. Any suitable conventional filling material may be utilized. Typical thermoplastic resins include, for example, acrylonitrile butadiene styrenes (ABS), polycarbonates, nylons, acrylics and the like. Typical thermosetting resins include, for example, alkyds, allylics, epoxies, phenolics, and the like. Plastic end flanges are preferred because they are easily molded and are less expensive. If desired, plastic end flanges may comprise electrically conductive components such as conductive filler particles of metal, carbon black or the like to impart electrical conductivity properties to the end flange.

Any suitable thermoplastic or thermosetting adhesive may be removed with the process of this invention. Typical adhesives include, for example, epoxy, cyanoacrylate, polyurethane, and the like. The adhesive material preferably comprises at least two components such as a resin and a curing agent. The deposited adhesive material may be free of any solvent. Typical multicomponent adhesive materials include, for example, epoxies, urethanes, acrylics, and the like. A preferred adhesive is epoxies. Epoxies can be monomers or prepolymers that further react with curing agents to yield a thermosetting polymer. Epoxy resins are characterized by the presence of a three-membered cyclic ether group referred to as an epoxy group, 1,2-epoxide, or oxirane. Preferred epoxy resins are diglycidyl ethers of bisphenol A derived from bisphenol A and epichlorohydrin. In addition to bisphenol, other polyols such as aliphatic glycols and novolacs may be used to produce epoxy resins. Epoxy resins may also include compounds based on aliphatic and cycloaliphatic backbones. The epoxy resins, prior to curing, range from low viscosity liquids to solid meltable resins. Typical curing agents to convert epoxy resin to a thermoset resin includes, for example, anhydrides, amines, polyamides, Lewis acids, and the like. Examples of hardener type curing agents for bisphenol A epoxy resins include, short-chain aliphatic polyamines such as diethylenetriamine and triethylenetetramine; oxylalkylated short-change polyamines such as $H_2NC_2H_4NHC_2H_4NHCH_2CH_2OH$ and $HOCH_2CH_2NHC_2H_4NHC_2H_4NHCH_2CH_2OH$; long-chain polyamine adducts such as trimethyl-1,6-hexanediamine and polyaminoamide, and the like. The mixing ratios for the bisphenol A epoxy resins and hardeners can range about 100 to about 10 to 100 to about 60, by weight, depending on the specific materials selected. Other epoxy resins that may be mixed with hardeners include, for example, epoxy phenol novolac resins with hardeners such as aromatic amines, catalytic curing agents, phenolics and anhydrides. If desired, mixture of epoxy resins may be utilized. A typical mixture includes, for example, triglycidyl-p-aminophenol resins mixed a bisphenol A-epoxy resin. Curing agents that are catalytic, initiate resin homopolymerization, either cationic or anionic, using a Lewis acid or base in the curing process. The Lewis acid catalysts can be a complex such borontrifluoride with amines or ethers. Curing agents that are co-reactive are polyfunctional reagents that are employed in stoichometric quantities. Typical classes of co-reactive curing agents include, for example, polyamines, polyaminoamides, polyphenols, polymeric thiols, polycarboxylic acids and anhydrides, and the like. Preferably, curing of the epoxy resins involves a liquid epoxy resin as cured via the epoxy groups at room temperature with nonaromatic amines and at slightly elevated temperatures with aromatic amines. Epoxy resins and curing agents for the epoxy resins are commercially available from companies such Celanese, Ciba-Geigy, The Dow Chemical Company, Reichold Chemicals, Shell Chemical Company, and Union Carbide Corporation. For room temperature curing systems, hardeners such as polyamides, aminoamides and aliphatic-amines are preferred. Typical curing agents include, for example, aliphatic amines such as diethylenetriamine, triethylenetetramine, and the like; aromatic amines such as meta-phenylenediamine, methylenedianiline, diaminodiphenylsulfone, and the like; catalytic curing agents such as piperidene, boron trifluoride-ethylamine complex, benzyldimethylamine, and the like; acid anhydrides such as acidic methyl anhydride, dodecenylsuccinic anhydride, hexahydrophthalic anhydride, alkendic anhydride, and the like. If desired, other additives, such as luminescent materials, may also be added to the adhesive mixture. Generally, room temperature curing adhesives are preferred to conserve energy and for heat sensitive electrophotographic imaging members. However, heat may be used, if desired, particularly where faster curing is desired.

Generally, the adhesive deposit on the inside surface of the cylindrical hollow photoreceptor has a width of between about 1/32 of an inch and about 1/4 of an inch. These adhesive deposits are generally between about 1/32 of an inch and about 1/8 of an inch high. These narrow adhesive material coating strips are generally adjacent to and parallel to the ends of the hollow cylindrical member. The narrow adhesive material coating strips preferably extend around at least about 270° of the inner peripheral surface of the hollow cylindrical member. Although an adhesive material coating strip may form a continuous ring of 360° is preferred to deposit less than 360° to provide an adhesive free gap when a conventional ground strip device is slid into the interior of the cylindrical imaging members that utilize an electrically insulating flange. Since the ground strip forms an electrical connection between the inner conductive surface of the hollow cylindrical member and an electrically conductive support shaft, such adhesive free gap avoids deposition of coating material on the contact surface of the ground strip during ground strip installation. If desired, the strip of adhesive may be discontinuous to conserve adhesive material. If discontinuous, sufficient separate segments of adhesive material should be deposited on a strip shaped region extending at least about 270° of the inner peripheral surface of the hollow cylindrical member to prevent slippage of the end flange after installation and drying or curing of the adhesive material, particularly if the flange carries drive gear teeth to which torque is applied during image cycling. Avoidance of end flange slippage assures registration of electrostatographic images and enhances achievement of quality electrostatographic images.

Generally, when utilized to support and drive a hollow electrostatographic imaging drum 12, the adhesively secured end flange 10 should withstand an applied torque of at least about 30 inch pounds (34.5 centimeter kilograms) on a 30 mm diameter cylindrical member without encountering slippage between the adhesively secured arcuate surface of the end flange and the adjacent inner surface of the hollow cylindrical imaging member. Where the hollow cylindrical member is driven by torque applied to an end flange located at one end of the cylindrical member and an end flange at the opposite end of the drum is employed to drive numerous other components of an imaging system, the end flanges will be subjected to considerable torque. Also, resistance to cylinder rotation due to peripheral devices such as cleaning blades, brushes or webs in contact with the outer imaging surface of a cylindrical member may need to be considered when determining the amount of torque that must be overcome without slippage between the end flange and the cylinder.

Removal of the flange and adhesive is effected by a combination of high pressure impact of carbon dioxide pellets and extremely low temperature reduction of the flange, adhesive and underlying aluminum surface.

The gas pressure utilized to propel the pellets against the flange and adhesive layer is preferably between about 70 psi and about 300 psi, depending on pellet size. When lower pressures are used the momentum of a pellet striking the adhesive coating can be insufficient to remove all the adhesive material. However, where appropriate, pressures up to about 300 psi may be employed. Typical gases for driving the pellets against the flange and adhesive include, for example, air, and the like. The air should be dehumidified. The pressurized gas may be provided by any suitable and conventional device such as a storage tank, piston compressor, turbine compressor, and the like. A pressure regulator is preferably utilized to regulate the gas pressure employed to propel the pellets at the adhesive deposits. The relative quantities of pellets and of accelerant gas which can be used together can be varied between wide limits and is not considered critical to the present process. Generally, the rate at which the pellets move through the nozzle is correlated with the volume of accelerant gas through the nozzle so that the emitted stream is not overloaded with pellets to the extent that there is danger of the pellets not being entrained within and not moving with the stream of pressurized gas.

The solid carbon dioxide particles may be of any suitable shape. Typical shapes include, for example, cubical, cylindrical, spherical, round, and the like. Cylindrically shaped pellets are preferred because pellet delivery equipment is more readily available. Preferably, the pellets are between about ½ inch long (12.7 millimeters) and about 1/16 inch long (1.6 millimeters). These pellets have a diameter of between about 0.032 inch (0.81 millimeter) and about 0.125 inch (3.2 millimeters). The size of these pellets should be sufficient to remove the adhesive coating and to detach the flange from the hollow cylindrical imaging member. The pellets are preferably formed by extruding solid carbon dioxide through a pelletizer, which chops or slices off the desired length of extruded carbon dioxide material. These pellets have a density of at least about 63 pounds per cubic foot (28.5 kilograms per square meter) and more preferably at least about 97 pounds per cubic foot (44 kilograms per square meter). The pellets may be formed with any suitable device. A typical carbon dioxide pellet forming device is described in U.S. Pat. No. 4,389,820, the entire disclosure thereof being incorporated herein by reference.

Preferably, the pellets are transported through any suitable conduit to a nozzle. It is preferred that the pellets are fed through the nozzle in single file. The pellets must be directed at the residual adhesive particles on the drum surface and/or flange surface with sufficient force to achieve separation of the adhesive deposits from the underlying surface. The nozzle design is conventional. The design of the nozzle depends upon the pellet size and pellet shape. For example, compressed air and the $CO_2$ particles are forced through a single hose convergent-divergent nozzle. This design will only allow a certain diameter particle to be used and is used for high velocity particle flow. A two hose nozzle uses the flow velocity through a primary tube to not only propel the particles, but also to create a vacuum to pull the pellets through a secondary tube, into a mixing tube where the air forces the pellets onto the surface to be blasted. Also, the nozzle may be intentionally expanded to produce destructive shock waves that fragment the particle size to create a smaller pellet for various adhesive removal applications. A typical nozzle is a "venturi" nozzle, described, for example, in U.S. Pat. No. 5,108,512, the entire disclosure thereof being incorporated herein by reference. Another type of nozzle is simply a straight or curved ii tube which preferably feeds the pellets in single file as a stream against the adhesive material. The nozzle is employed to direct and focus solid carbon dioxide pellets at the flange and adhesive coating present on the inside surface of the ends of the hollow cylindrical imaging member. In addition to removing adhesive from the inner surface of the ends of hollow cylindrical imaging members or drums, the process of this invention may also be used to remove adhesive material from the outer periphery of flanges after they have been removed from the ends of the hollow cylindrical imaging members. The ends of the photoreceptor may vary in size and shape. If desired, multiple nozzles may be employed to reduce cycle time during which the adhesive deposits are removed. Possibly, a ring nozzle or ring of nozzles can be employed to remove all of the adhesive deposits simultaneously. Generally, the end of the nozzle is spaced very closely to the adhesive deposit. Typical distances are between about 0.039 inch (1 millimeter) and about 5 inches (127 millimeters).

The temperature of the flange, adhesive deposit and underlying substrate should be cooled sufficiently by the carbon dioxide particles and gas propellant to cause the adhesive to become brittle and to separate from the underlying aluminum surface due to the difference in coefficient of contraction. This occurs very rapidly. Thus, for example, a single nozzle in combination with a hollow cylindrical photoreceptor having a diameter of about 15 millimeters to about 160 millimeters rotated at about 1 rpm can effectively remove the adhesive deposits after removal of the flange. The number of revolutions of the drum during the exposure of the adhesive deposits to a high velocity stream of solid carbon dioxide particles should be sufficient to subject all of the deposited adhesive particles to the carbon dioxide stream. Since the adhesive deposit might not extend 360° around the interior of the end of a hollow cylindrical photoreceptor, the number of partial or complete revolutions need only be sufficient to subject the adhesive deposits to impact by the carbon dioxide pellets. Thus, for example, if the adhesive deposits only occupy 270° of the inner surface of an end of a hollow cylindrical photoreceptor, the cylinder need only be rotated 270° to expose only the deposits and underlying layer to the stream of carbon dioxide pellets. The cylinder may be rotated by any suitable device. Typical rotating devices include, for example, parallel support rollers in which at least one roller is driven, chucks which grip and rotate the cylinder, air bladders, and the like. If desired, the nozzle may be moved relative to a stationary or rotating cylinder. Moreover, both the nozzle and the cylinder may be moved relative to each other. Speed control of the nozzle and/or cylinder rotating devices may be accomplished by any conventional apparatus using microprocessors, limit switches, variable speed motors, pneumatic motors, and the like. The stream of carbon dioxide pellets may be continuously or intermittently applied so long as all of the adhesive deposits are struck, reduced sufficiently in temperature and removed by the pellets.

Surprisingly the process of this invention effectively removes the flange and adhesive deposits from the interior end of a photoreceptor cylinder while not adversely affecting the photoreceptor coating on the outside of the photoreceptor. This permits a fresh unused photoreceptor that has an improperly installed flange to be recycled for removal of the flange without damaging the outside photoreceptor layer. Thus, instead of scrapping the fresh unused photoreceptor, the photoreceptor may merely have another flange installed and then shipped for use.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A hollow cylindrical electrostatographic imaging member having an interior surface, a coated outer surface, a first end and a second end was provided comprising a 14 millimeter inside diameter aluminum drum having an outer coating comprising conventional layers including a 1 micrometer thick blocking layer, a 2 micrometer thick charge generating layer of pigment particles dispersed in a film forming polymer and a 24 micrometer thick charge transport layer of charge transporting molecules dissolved in a film forming polymer. The first end of the interior surface of the drum had a strip of cross linked epoxy adhesive material extending about 320° around the inner periphery of the drum. The strip was 10 millimeters from the first end of the drum. The width of the strip was 6 millimeters and the thickness was 3 millimeters. Because the epoxy adhesive material was cross linked, it was insoluble in solvents. A stream of solid carbon dioxide pellets were propelled by pressurized air through a nozzle against the strip of adhesive material with sufficient thermal shock to blast the adhesive material from the interior surface at the first end of the drum. The pellets had a cylindrical shape and had a diameter of 2 millimeters and a length of 10 millimeters. Air pressure was 206 kilograms per square centimeter. The angle of attack of the stream of pellets was 30 degrees (see $\theta_1$ in FIG. 3) relative to an imaginary extension of the inner surface of the drum and 15 degrees when measured from an imaginary plane extending through the axis of drum in a direction parallel to the axis of drum (see $\theta_2$ in FIG. 4). The nozzle was stationary and the drum was rotated at 200 revolutions per minute while supported on a pair rotating closely spaced parallel rollers. All of the adhesive was removed in 3 revolutions of the drum. When the strip of cross linked epoxy adhesive material secures a flange to the inner surface of the drum, a stream of solid carbon dioxide pellets can be propelled by pressurized air through a nozzle introduced into the interior of the drum from the second end so that the solid carbon dioxide pellet strike the inner end of the flange adjacent the strip of adhesive material. The stream of solid carbon dioxide pellets should be propelled with sufficient thermal shock to blast the flange and adhesive material from the interior surface at the first end of the drum.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process for treating an electrostatographic imaging member comprising providing a hollow cylindrical electrostatographic imaging member having an interior surface, a coated outer surface, a first end and a second end, wherein the second end of the hollow cylindrical electrostatographic imaging member has an opening and the solid carbon dioxide pellets are introduced through the opening at the second end and propelled against the first end flange and coating of adhesive material at the first end of the hollow cylindrical electrostatographic imaging member, the interior surface at at least the first end having a coating of adhesive material securing a first end flange to the first end or securing a second end flange to the second end, and propelling solid carbon dioxide pellets against the first end flange and coating of adhesive material with sufficient force to remove the first end flange and coating of adhesive material from the interior surface at at least the first end of the hollow cylindrical electrostatographic imaging member.

2. A process according to claim 1 wherein the first flange comprises a first rim having an exposed circular periphery.

3. A process according to claim 2 wherein at least about 320 degrees of arc of the exposed circular periphery of the rim is glued to the interior surface of the hollow cylindrical electrostatographic imaging member.

4. A process according to claim 1 wherein the hollow cylindrical member is an electrophotographic imaging member.

5. A process according to claim 1 wherein the adhesive material is a cross linked thermoset adhesive.

6. A process according to claim 5 wherein the adhesive material is an epoxy resin.

7. A process according to claim 1 wherein the coating of adhesive material at at least the first end secures a first drum supporting end flange comprising a first rim having a circular periphery to the first end of the hollow cylindrical electrostatographic imaging member, the second end of the hollow cylindrical electrostatographic imaging member is open, and the solid carbon dioxide pellets are introduced through the open second end and propelled against the coating of adhesive material at the first end of the hollow cylindrical electrostatographic imaging member and the circular periphery of the first end flange to separate the first end flange from the first end of the hollow cylindrical electrostatographic imaging member and to remove the adhesive material from the interior surface at the first end of the hollow cylindrical electrostatographic imaging member.

8. A process according to claim 1 wherein the first end of the hollow cylindrical electrostatographic imaging member is open and, subsequent to removal of the flange, solid carbon dioxide pellets are introduced through the open first end and propelled against residual coating of adhesive material at the first end of the hollow cylindrical electrostatographic imaging member.

9. A process according to claim 8 wherein the propelled solid carbon dioxide pellets introduced through the open first end follow a path which forms an angle of between about 10 degrees and about 60 degrees measured from an imaginary line extending away from the interior surface of the hollow cylindrical electrostatographic imaging member in a direction parallel to an imaginary axis of the hollow cylindrical electrostatographic imaging member.

10. A process according to claim 1 wherein a second drum supporting end flange comprising a second rim having a circular periphery and an annular hole is secured by an adhesive coating to the second end of the hollow cylindrical electrostatographic imaging member, and the solid carbon dioxide pellets are introduced through the annular hole and propelled against the first end flange and coating of adhesive material at the first end of the hollow cylindrical electrostatographic imaging member to separate the first end flange from the first end of the hollow cylindrical electrostatographic imaging member.

11. A process according to claim 10 wherein the solid carbon dioxide pellets are introduced through the annular hole by a hollow tube extending through the annular hole.

12. A process according to claim 10 wherein first end of the hollow cylindrical electrostatographic imaging member is open after the first end flange is separated from the first end of the hollow cylindrical electrostatographic imaging member and solid carbon dioxide pellets are introduced through the open first end and propelled against the coating of adhesive material at the second end of the hollow cylindrical electrostatographic imaging member.

13. A process according to claim 1 including propelling the carbon dioxide pellets with compressed gas.

14. A process according to claim 13 wherein the compressed gas is air.

15. A process according to claim 13 wherein the compressed gas is nitrogen.

16. A process according to claim 13 wherein the compressed gas is under a pressure of between about 80 psi and about 300 psi.

17. A process according to claim 1 wherein the pellets have a substantially cylindrical shape.

18. A process according to claim 17 wherein the pellets have a length of between about 12.7 millimeters and about 1.6 millimeters and a diameter of between about 2 millimeters and about 3.2 millimeters.

19. A process according to claim 1 wherein the pellets have a density of at least about 28.5 kilograms per square meter.

20. A process according to claim 1 wherein the pellets have a density of at least about 44 kilograms per square meter.

* * * * *